United States Patent [19]

Razza

[11] Patent Number: 5,044,175

[45] Date of Patent: Sep. 3, 1991

[54] CONVERTIBLE BROOCH

[76] Inventor: Luca Razza, 29 Trellis Dr., West Warwick, R.I. 02893

[21] Appl. No.: 585,869

[22] Filed: Sep. 19, 1990

[51] Int. Cl.[5] ..... A44C 13/00

[52] U.S. Cl. ..... 63/1.1; 63/20

[58] Field of Search ..... 63/1.1, 2, 29.1, 20

[56] References Cited

U.S. PATENT DOCUMENTS

| | | | |
|---|---|---|---|
| 1,917,325 | 7/1933 | Placco | 63/20 |
| 1,981,521 | 11/1934 | Mazer | 63/20 |
| 2,119,178 | 5/1938 | Pennino | 63/20 |
| 2,144,375 | 1/1939 | Huppert | 63/20 |
| 2,225,890 | 12/1940 | Schwarzkopf | 63/20 X |

FOREIGN PATENT DOCUMENTS

| | | | |
|---|---|---|---|
| 732308 | 6/1955 | United Kingdom | 63/1.1 |

*Primary Examiner*—Laurie K. Cranmer

*Attorney, Agent, or Firm*—Salter & Michaelson

[57] ABSTRACT

A convertible brooch includes a pair of earring elements, each including an ornament portion, a connecting plate for securing the earring elements together so that the ornament portions thereof cooperate to define an enlarged brooch ornament and a pin assembly for securing the brooch to a garment of a wearer. The earring elements are normally securely retained on the connecting plate but they can be readily disassembled therefrom for use as conventional earrings.

2 Claims, 2 Drawing Sheets

CONVERTIBLE BROOCH

BACKGROUND AND SUMMARY OF THE INVENTION

The instant invention relates to ornamental jewelry and more particularly to a brooch assembly comprising a pair of earrings which can be readily disassembled from the brooch assembly for use as conventional earrings.

While a wide variety of different types of ornamental jewelry items have been heretofore available, the vast majority of heretofore available jewelry items have been single purpose items, such as earrings, brooches, or pendants, which have not been adapted for alternative uses. Nevertheless, a limited number of heretofore available jewelry items have been adapted for multipurpose use. For example, the patent to BANGS et al U.S. Pat. No. 2,863,306, which represents the closest prior art to the subject invention to which the applicant is aware, discloses a brooch which is adapted for alternative use as a single earring. Other types of brooches comprising several jewelry clip elements have also been heretofore available. However, the clip elements of these devices have not been adapted to be alternatively worn as earrings.

The instant invention provides an effective convertible brooch comprising a pair of earrings. More specifically, the convertible brooch of the instant invention comprises first and second earring elements, each of which includes an ornament portion and attaching means on the rear side of the ornament portion thereof for releasably securing the ornament portion to an ear lobe of a wearer. The convertible brooch further comprises a retaining or connecting member receivable on the attaching means of the earring elements for securing the earring elements together so that the ornament portions thereof are positioned in side-by-side relation, and support means for supporting the brooch assembly on a wearer. The support means preferably comprises a pin assembly which is securable to a garment of a wearer, and the attaching means of the earring elements preferably comprise pressure clip-type attaching means for attaching the ornament portions of the earring elements to the ear lobes of a wearer. Each of the ornament elements preferably has a mating edge portion, and the ornament elements are preferably constructed so that the mating edge portions thereof are receivable in mating engagement. Further, the connecting means is preferably operative for connecting the earring elements so that the mating edge portions thereof are received in mating engagement in a manner wherein the decorative portions of the earring elements cooperate to define an enlarged ornament portion of a brooch. The pressure clip attaching means of each of the earring elements preferably includes a pivotable clip arm, a stationery clip pad and means resiliently biasing the clip arm thereof toward the clip pad thereof. The connecting means preferably includes a connecting plate having a pair of spaced apertures therein which are adapted for receiving the clip arms in snug engagement with the clip pads for positioning the earring elements relative to the connecting plate. Further, the connecting means preferably includes a pair of rearwardly extending flanges at opposite ends thereof which are engageable with the terminal ends of the clip arms for retaining the connecting plate in a locked position wherein the connecting plate is operative for rigidly connecting the earring elements together in side-by-side relation. Further, each of the pressure clip attaching means preferably includes a base portion having a reduced forward notch portion which is located adjacent the respective ornament portion thereof, and the apertures in the connecting plate preferably include enlarged outer main portions which are dimensioned for receiving the clip arms and the main portions of their respective base portions and reduced inner end portions which are dimensioned for receiving the forward notch portions of the base portions, but not the main portions thereof. Accordingly, by assembling the clip arms and the base portions of the pressure clip attaching means through the apertures in the connecting plate so that the connecting plate is aligned with the forward notch portions of the base portions and then moving the earring elements together into mating engagement, the notch portions of the base portions can be passed into the reduced portions of the apertures to further secure the connecting plate onto the base portions of the clip attaching means. By thereafter pivoting the clip arms to closed positions so that they engage the rearwardly extending flanges on the connecting plate, the earrings can be locked in assembled relation with the connecting plate.

Accordingly, it is a primary object of the instant invention to provide an effective convertible brooch which is adapted to be disassembled to provide a pair of earrings.

Another object of the instant invention is to provide a convertible brooch comprising a pair of pressure clip earrings, a connecting plate for securing the earrings together so that they cooperate to form an enlarged ornament, and a pin assembly for securing the connecting plate and the earring elements to a garment of a wearer.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
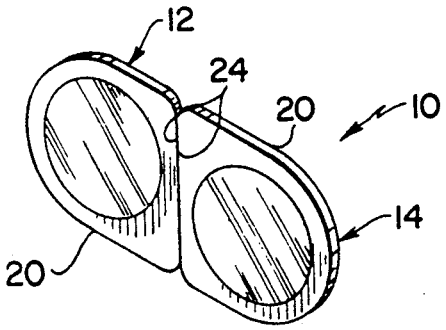
FIG. 1 is a front perspective view of the brooch of the instant invention.
Figure 2:
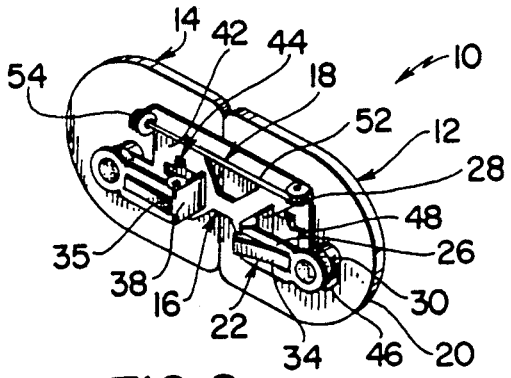
FIG. 2 is a rear perspective view thereof.

Referring now the drawings, the convertible brooch of the instant invention is illustrated in FIGS. 1–6 and generally indicated at 10. The brooch 10 comprises a pair of earring elements generally indicated at 12 and 14, a connecting plate generally indicated at 16, and a fastening pin assembly generally indicated at 18. The earring elements 12 and 14 comprise pressure clip-style earring elements and they are adapted to be worn on the ears of a wearer in a conventional manner. Alternatively, the earring elements 12 and 14 can be assembled with the connecting plate 16 so that the earring elements 12 and 14 are received and retained in an assembled relation wherein they cooperate to define an enlarged brooch ornament. The fastening pin assembly 18 is secured to the rear side of the connecting plate 16, and it is operative for securing the brooch 10 to a garment of a wearer.

The earring elements 12 and 14 each comprise an ornament portion 20 and an attaching assembly generally indicated at 22 which is secured to the rear side of the ornament portion 20 thereof. Each of the ornament portions 20 includes a mating edge 24 which is configured to be received in mating engagement with the mating edge 24 of the other ornament portion 20. Each of the attaching assemblies 22 comprises a clip arm 26 which is pivotally mounted on a base portion 28 attached to the rear side of the ornament portion 20 thereof and a clip pad 30 which is also attached to the rear side of the ornament portion 20 thereof. Each of the clip arms 26 is pivotally mounted on the base portion 28 thereof with a pivot pin 32, and each of the clip arms 26 includes an integrally blanked spring portion 34 which is enagageable with an extension 35 on the rear end of the base portion 28 thereof for biasing the clip arm 26 thereof to an opertive position wherein it is received in clamping engagement with the respective clip pad 30 thereof. In this regard, each of the clip pads 30 is positioned in spaced relation to the respective base portion 28 thereof on the ornament element 20 thereof, and each of the clip arms 26 thereof further includes a pad element 36 which is biased toward a position of engagement with the clip pad 30 thereof when the clip arm 26 thereof is in a closed position. Each of the base portions 28 includes an enlarged main portion 38 having a predetermined width and a reduced or notched portion 40 having a reduced second width. Each of the notched portions 40 is positioned adjacent the rear side of the respective decorative portion 20 thereof as illustrated most clearly in FIG. 3.

Figure 3:
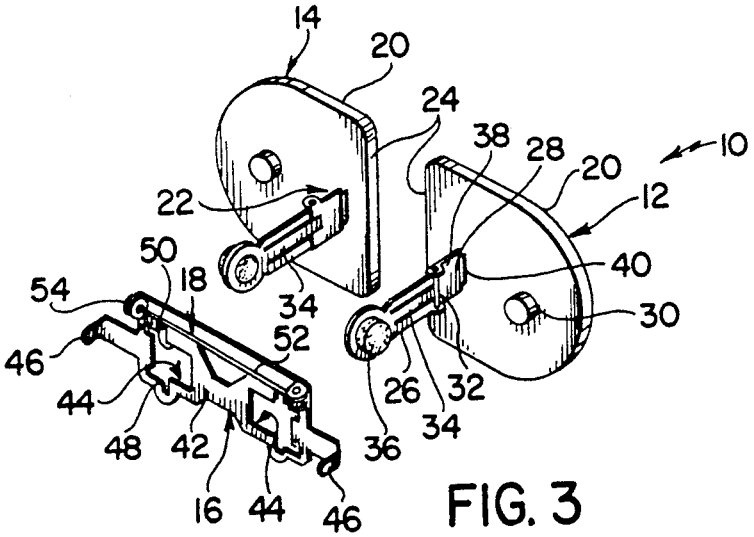
FIG. 3 is a rear exploded perspective view thereof.
Figure 4:
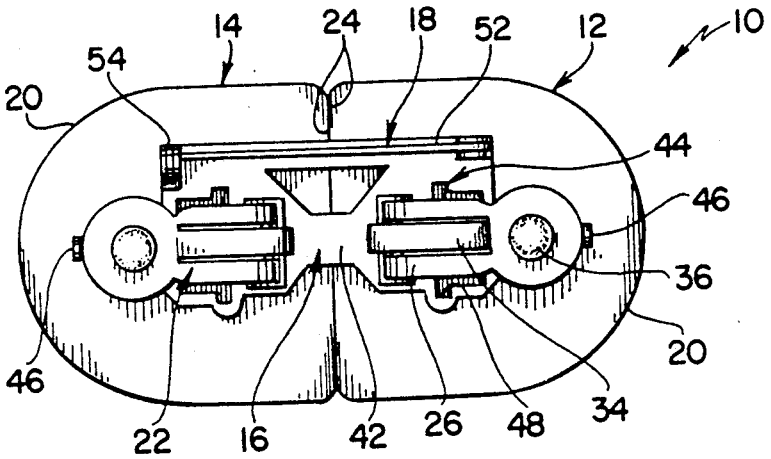
FIG. 4 is an enlarged rear plan view thereof.
Figure 5:
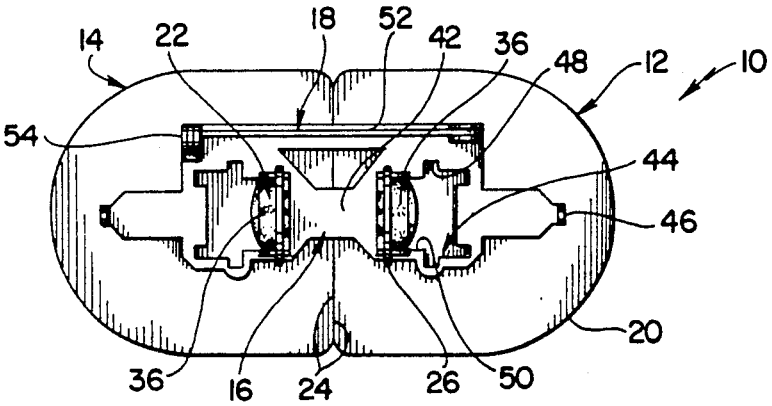
FIG. 5 is a similar view with the clip arms in the unlocked positions thereof.
Figure 6:
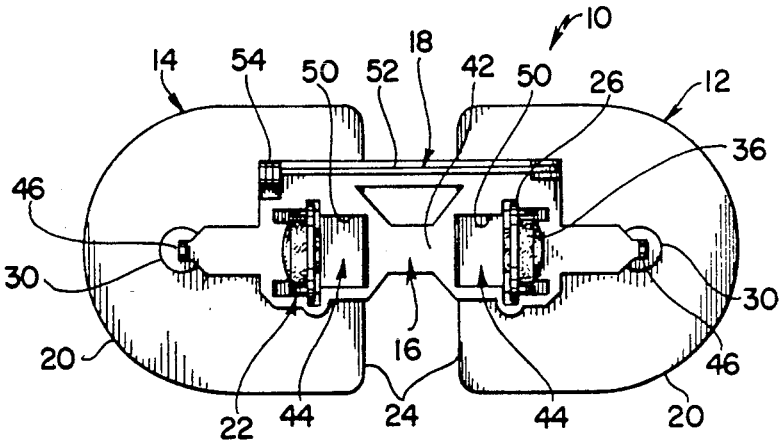
FIG. 6 is a similar view with the clip arms in the unlocked positions thereof and the earring elements separated to disassemble them from the connecting plate.

For use and operation of the earring elements 12 on the ears of a wearer, the clip arms 26 are first positioned in the rearwardly extending open positions thereof illustrated in FIG. 3, and the decorative portions 20 are positioned adjacent to front surfaces of the ear lobes of the wearer. The clip arms 26 are then pivoted toward the respective clip pads 30 thereof to capture the ear lobes of the wearer between the pad elements 36 and the respective clip pads 30 thereof. When the clip arms 26 are pivoted toward the respective clip pads 30 thereof, the spring portions 34 operate to bias the pad elements 36 toward the clip pads 30 to firmly secure the ear lobes of the wearer between the pad elements 36 and the clip pads 30.

The connecting plate 16 is preferably integrally blanked from a suitable sheet metal, and it includes a main plate portion 42 having a pair of apertures 44 therein and a pair of flanges 46 which extend rearwardly from opposite ends of the main plate portion 42. The apertures 44 include enlarged portions 48 which are dimensioned for receiving the clip arms 26 and the base portions 28 therethrough and reduced inner portions 50 which are dimensioned for receiving the reduced or notched portions 40 of the base portions 28 but not the main portions 38 thereof or the clip arms 26. Accordingly, the connecting plate 16 is adapted to be assembled with the earring elements 12 and 14 by passing the clip arms 26 and the base portions 28 through the enlarged portions 48 of the apertures 44 until the main plate portion 42 of the connecting plate 16 is aligned with the notched portions 40. Thereafter, by moving the earring elements 12 and 14 inwardly and together so that the notched portions 40 are received in the reduced inner portions 50 and the mating edges 24 are received in mating engagement, the earring elements 12 and 14 can be effectively secured to the connecting plate 16. Further, by then pivoting the clip arms 26 to the closed positions thereof so that the connecting plate 16 is interposed between the pads 36 and the clip pads 30, the earring elements 12 and 14 can be effectively locked on the connecting plate 16. In this regard, when the clip arms 26 are pivoted to the closed positions thereof, the terminal ends of the clip arms are received inside of the flanges 46 so that the flanges 46 prevent the earring elements 12 and 14 from being separated to remove them from the connecting plate 16.

The pin assembly 18 comprises a pin 52 which is pivotally mounted on the connecting plate 16 and adapted for piercing a garment of a wearer in order to secure the brooch 10 thereto. The pin assembly 18 further comprises a rotatable retainer member 54 of conventional construction which is rotatable between an open position wherein the pin 52 can be pivoted outwardly and a closed position wherein the pin 52 is retained in the closed position illustrated in FIGS. 1 and 4–6.

Accordingly, for use and operation of the brooch 10, the pin 52 can be pivoted outwardly from the connecting plate 18 for securing the brooch 10 to a garment of a wearer in a conventional manner. Alternatively, in order to wear the earring elements 12 and 14 as conventional earrings, the connecting plate 16 can be disassembled from the earrings 12 and 14. Specifically, the earrings can be disassembled by pivoting the clip arms 26 rearwardly to the open positions thereof so that the terminal ends of the clip arms 26 are disengaged from the flanges 46. Once the clip arms 26 have been pivoted rearwardly, the earring elements 12 and 14 can be separated by moving the base portions 28 thereof outwardly and apart so that they are removed from the reduced inner portions 50 of the apertures 44. Once the base portions 28 have been aligned with the enlarged portions 48 of the apertures 44, the base portions 28 and the clip arms 26 can be passed through the apertures 44 to disengage the earring elements 12 and 14 from the connecting plate 16. The earring elements 12 and 14 can then be assembled on the ear lobes of a wearer in a conventional manner as hereinabove set forth.

It is seen therefore that the instant invention provides an effective convertible brooch. The earring elements 12 and 14 can be readily and easily assembled with or disassembled from the connecting plate 16 to enable the earring elements 12 and 14 to be alternatively utilized as the ornament portion of a brooch or as separate earrings which can be worn on the ears of a wearer in a conventional manner. In this regard, it is seen that the connecting plate 16 provides an effective and convenient means of detachably securing the earring elements 12 and 14 together utilizing the attaching assemblies 22 thereof. Accordingly, it is seen that the instant invention represents a significant advancement in the jewelry art which has a substantial degree of commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible brooch comprising first and second earring elements, each of said earring elements including an ornament portion having front and rear sides and pressure clip type attaching means on the rear side of the ornament portion thereof for releasably attaching the earring element to an ear lobe of a wearer, each of said ornament portions having a mating edge portion, the mating edge portions of said ornament portions being receivable in mating engagement with each other, each of said pressure clip attaching means including a pivotable clip arm, a stationery clip pad, and means for resiliently biasing the clip arm thereof toward the clip pad thereof, connecting means engageable with the attaching means of each of said earring elements for securing said earring elements together so that the ornament portions thereof are positioned in substantially side-by-side relation with said mating edge portions in mating engagement and with the front sides thereof facing in substantially the same direction, said connecting means including a connecting plate which is receivable on said clip arms for connecting said earrings elements together, said clip arms being engageable with said connecting plate for retaining said connecting plate in a locked position wherein said connecting plate is operative for rigidly connecting said earring elements together in side-by-side relation, said connecting plate having a pair of rearwardly extending flanges at opposite ends thereof, said clip arms terminating in outer terminal ends, the outer terminal ends of said clip arms engaging said flanges for retaining said connecting plate in said locked position, and support means on said connecting means for releasably supporting said connecting means with said earring elements attached thereto on a wearer.

2. A convertible brooch comprising first and second earring elements, each of said earring elements including an ornament portion having front and rear sides and pressure clip type attaching means on the rear side of the ornament portion thereof for releasably attaching the earring element to an ear lobe of a wearer, each of said ornament portions having a mating edge portion, the mating edge portions of said ornament portions being receivable in mating engagement with each other, each of said pressure clip attaching means including a pivotable clip arm, a stationery clip pad, and means for resiliently biasing the clip arm thereof toward the clip pad thereof, connecting means engageable with the attaching means of each of said earring elements for securing said earring elements together so that the ornament portions thereof are positioned in substantially side-by-side relation with the front sides thereof facing in substantially the same direction, said connecting means including a connecting plate which is receivable on said clip arms for connecting said earring elements together, said connecting plate having a pair of spaced apertures therein, said clip arms being receivable through said apertures for assembling said connecting plate with said earring elements, each of said pressure clip attaching means including a base portion extending rearwardly from the respective ornament portion thereof and terminating in a rear end, each of said clip arms being pivotally attached to the respective base portion thereof adjacent the rear end thereof, each of said base portions including a rearward portion of a first width and a forward notched portion of a reduced second width located adjacent the respective ornament portion thereof, each of said apertures including an enlarged outer portion which is dimensioned for receiving one of said clip arms and the outer portion of the respective base portion thereof therethrough and a reduced inner portion which is dimensioned for receiving the forward notched portion of the base portion of one of said arms therein but not the main portion of the base portion thereof, the notched portions of said base portions being receivable in the reduced portions of said apertures by passing the clip arms and the main portions of the base portions of the clip attaching means of the earring elements through the enlarged portions of said apertures so that the notched portions of the base portions are aligned with the connecting plate and then moving the earring elements together into mating engagement to advance the notched portions of the base portions into the reduced portions of their respective apertures, said brooch further comprising support means on said connecting means for releasably supporting said connecting means with said earring elements attached thereto on a wearer.

* * * * *